United States Patent [19]

Pace

[11] 4,367,700

[45] Jan. 11, 1983

[54] APPARATUS FOR INSURING THE COMPLETE BURNING OF FUEL IN A SIX CYCLE COMBUSTION ENGINE

[75] Inventor: James L. Pace, Calvert City, Ky.

[73] Assignee: Hotspur International Corporation, Inc., Louisville, Ky.

[21] Appl. No.: 225,995

[22] Filed: Jan. 19, 1981

[51] Int. Cl.[3] ..... F02B 75/02; F02M 31/00

[52] U.S. Cl. ..... 123/64; 123/41.82 R; 123/556; 123/592; 123/549

[58] Field of Search ..... 123/41.72, 41.74, 41.82 R, 123/590, 592, 593, 549, 555-557, 64, 198 D

[56] References Cited

U.S. PATENT DOCUMENTS

| | | | |
|---|---|---|---|
| 787,254 | 4/1905 | Young | 123/592 |
| 1,091,703 | 3/1914 | Pratt | 123/64 |
| 1,156,716 | 10/1915 | Shores | 123/592 |
| 1,414,081 | 4/1922 | Gollogly | 123/198 D |
| 1,677,019 | 7/1928 | Casati et al. | 123/198 D |
| 3,125,082 | 3/1964 | Stansfield et al. | 123/41.82 |
| 3,554,174 | 1/1971 | Clawson | 123/556 |
| 3,850,152 | 11/1974 | Hollins | 123/556 |
| 4,020,815 | 5/1977 | Hubert | 123/549 |
| 4,092,963 | 6/1978 | Vrooman | 123/549 |

FOREIGN PATENT DOCUMENTS

| | | | |
|---|---|---|---|
| 645092 | 10/1928 | France | 123/592 |

*Primary Examiner*—Craig R. Feinberg

[57] ABSTRACT

A six cycle combustion engine is disclosed which utilizes the 5th and 6th cycle for drawing in and expelling preheated air to further warm the combustion chamber. The flow of the coolant water has been reversed so that heat absorbed in the engine head will flow to the cylinder walls and give a warming trend thereto. In addition, a fuel system is disclosed which insures the complete mixing of air and fuel vapor molecules prior to their deliverance to the intake of the engine.

10 Claims, 4 Drawing Figures

APPARATUS FOR INSURING THE COMPLETE BURNING OF FUEL IN A SIX CYCLE COMBUSTION ENGINE

BACKGROUND AND OBJECTS OF THE INVENTION

This invention relates to internal combustion engines and more specifically to a novel engine design and fuel system therefore.

It is the primary object of this invention to provide an improved internal combustion engine and fuel system therefore which exhibits very high efficiency and low hydrocarbon emission characteristics due to a near perfect combustion of the admixture of air and fuel forming the charge.

This is achieved by providing a six cycle engine having a heat exchanger which furnishes heated air to the cylinders on the 5th stroke to further heat same and which air is expelled on the 6th stroke. In addition, the flow of coolant in the engine has been changed from the conventional method of absorbing heat from the cylinder walls first and then the engine head to permitting the coolant to absorb heat from the engine head first and transfer this heat to the cylinder wall to impart a warming trend thereto. A new fuel system is also disclosed which ensures that the mixture of fuel and air is as complete as possible before entering the intake manifold of the engine.

The prior art structure of which applicant is aware is exemplified, for example, in U.S. Pat. No. 2,355,806 which discloses a six cycle engine wherein additional air is introduced on the 5th stroke and expelled on the 6th stroke. However, the air is substantially cool and is introduced to reduce the temperature of the cylinder head and walls to prevent preignition and not for the purpose of controlling the inner skin surface to inhance combustion as does applicant. Another U.S. Pat. No. 3,964,263 discloses a six cycle engine which teaches the use of fins to increase the temperature inside the combustion chamber, however, the purpose is to readily vaporize a liquid such as water which is introduced during the fourth stroke of the engine and not to increase the temperature of the inner skin surfaces to enhance combustion of the air and fuel mixture as does applicant.

It is therefore a further object of the present invention to provide a six cycle internal combustion engine which utilizes heated air introduced on the 5th cycle thereof to increase the inner skin surface temperature of the head and cylinder walls to facilitate more complete combustion of the charge.

It is another object of the present invention to provide an internal combustion engine with a reversed coolant flow therethrough to inhance the internal temperature of the cylinder walls to further improve combustion.

It is a yet another object of the present invention to provide an improved fuel system for an internal combustion engine and one which insures the thorough mixing of the air and fuel forming the charge.

It is a still further object to provide an internal combustion engine of 6 cycle type which is of simple construction, economically feasible, and relatively trouble free in operation.

The novel features which are believed to be characteristic of the invention, both as to its organization and method of operation, together with further objectives and advantages thereof will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE INVENTION

Figure 2:
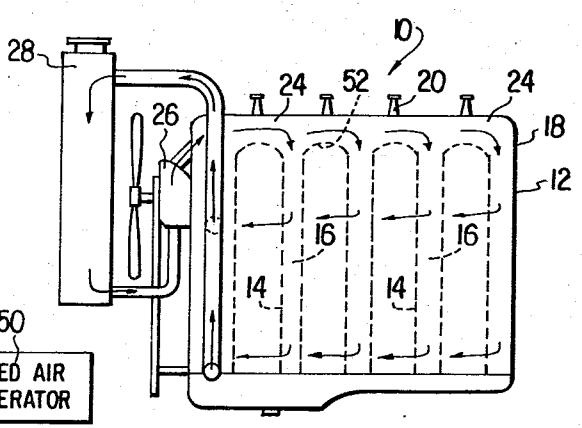
FIG. 2 is a side elevational view of the engine of FIG. 1.
Figure 1:
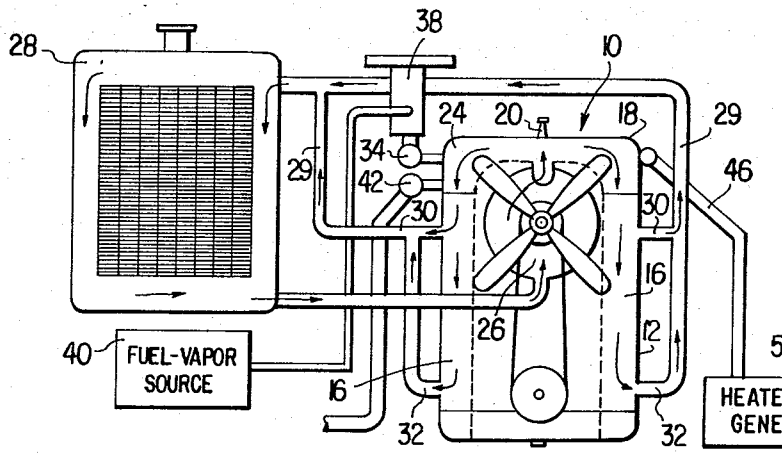
FIG. 1 is a front elevational view of an internal combustion engine showing the direction of coolant flow according to the principles of the present invention.

Referring now to the drawings where like characters of reference refer to like elements in each of the several views, FIGS. 1 and 2 show a conventional four cylinder internal combustion engine 10 of the six stroke cycle type it being understood of course that the number of cylinders can be increased or decreased without departing from the spirit of the invention, and four are shown in FIG. 1 for the purpose of illustration. The engine 10 has a block 12 with cylinder walls 14 surrounded by passageways 16 through which a coolant is passed. The engine 10 also has a head 18 containing the spark plugs 20 and valving 22 positioned above the block 12. The head 18 has passageways 24 therethrough which communicate with passageways 16 in the block. The passageways 24 in the head 18 are connected to an engine driven coolant pump 26 which in turn is connected by a hose to a radiator 28 at one end thereof. The other end of the radiator 28 is connected by hosing 29 to upper outlet 30 and lower outlet 32 in the block 12 which outlets communicate with passageways 16 therethrough.

Typically, because the highest degree of heat in an internal combustion engine is generated in the head 18 and the portion of the cylinders adjacent thereto, the flow of coolant has been first through the block passageways 16, then through the head passageways 24 and back to the radiator 28. However, because applicant has discovered that additional heat along the length of the cylinder walls 14 materially aids in ensuring the complete combustion of the fuel and air mixture fed thereto with the resultant increase in efficiency and decrease in hydrocarbon emissions, the direction of coolant flow has been reversed as can be seen by the arrows in FIGS. 1 and 2. More specifically, the coolant is caused by pump 26 to enter the head passageways 24 first whereupon heat is absorbed by the coolant. As the heated coolant travels to the passageways 16 in the block 12, the head absorbed therein provides a warming trend to the cylinder walls 14 prior to its exit through outlets 30, 32 and return to the radiator 28 via hose 29.

The engine 10 has a fuel and air intake manifold 34 connected at one end to each intake valve 36 and at the other end to a fuel-air supply system comprising a carburetor 38 and a source of low pressure vaporized fuel 40. The engine 10 also has a conventional exhaust manifold 42 connected at one end to each exhaust valve 44 and at the other end to a conventional muffler system (not shown). In addition, the engine 10 has a heated air manifold 46 connected at one end to each heated air inlet valve 48 and at the other end to a heated air generator 50.

Figure 3:
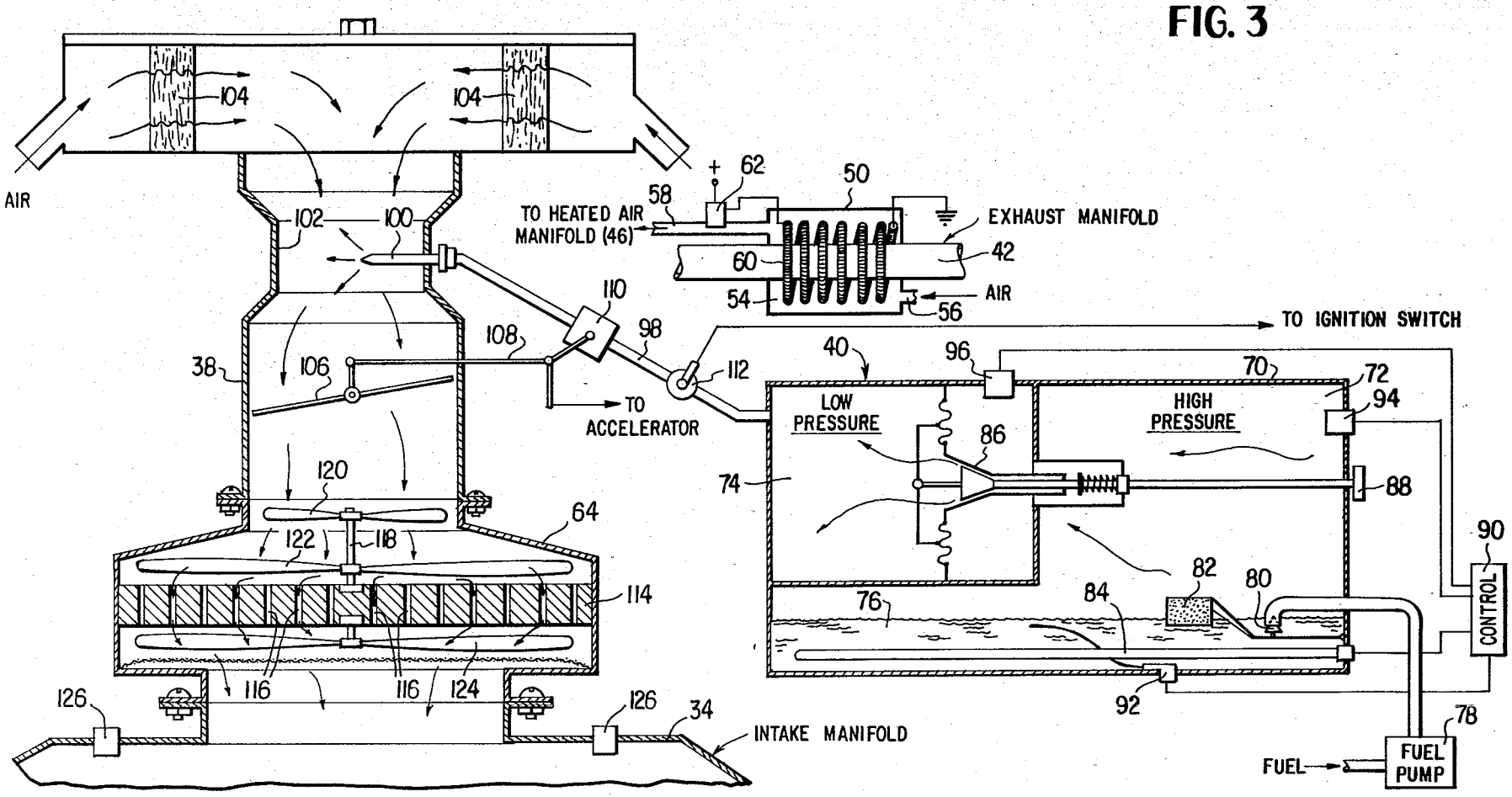
FIG. 3 is a schematic illustration of the fuel system for an internal combustion engine according to the invention.

The heated air generator 50 serves the function of supplying a quantity of warm air to the cylinders walls 14 of the engine to insure that the walls 14 as well as the inner surface 52 of the head 18 is at a constant, preselected temperature at all times to enhance the combustion efficiency of the air-fuel mixture burned therein. The generator 50 as disclosed in FIG. 3 comprises a housing 54 which surrounds a portion of the exhaust manifold 42. The housing 54 has an inlet 56 for introducing air to the interior thereof and an outlet 58 connected to the heated air manifold 46. An electric resistance-type heating element 60 is located within the housing 54 and it is connected to a source of current (not shown) via a thermostatically controlled switch 62 which senses the temperature in outlet 58 to thereby control energization of the heating element 60. In operation, prior to the exhaust manifold 42 reaching its normal operating temperature as the engine 10 is started up, the switch 62 will energize the heating element 60 to warm the air being drawn through inlet 56 prior to its introduction to the cylinders via inlet valves 48. As the exhaust manifold 42 reaches operating temperature, the heating element 60 is deenergized and the air from inlet 56 is heated directly by the exhaust manifold 42 itself. The air in outlet 58 is maintained typically in excess of 100° F.

In addition to the aforedescribed ways of insuring that the cylinder walls 14 and inner surface 52 of head 18 are at a higher temperature than normally experienced in conventional internal combustion engines, namely by the reversal of the coolant flow from the head passageways 24 to the cylinder passageways 16 and the heated air injected through valve 48 from generator 50, the fuel-air mixture forming the charge introduced into the intake manifold 34 is also novel thereby insuring greater combustion efficiency than previously experienced. The charge is formed, generally speaking, by combining vaporized fuel preferably of the no-lead type from generator 40 with air in the carburetor 38 and then thoroughly mixing the combined air and vaporized fuel molecules in a mixing device 64 prior to their entrance into intake manifold 34. It being understood of course that fuels other than gasoline can be used just as effectively in forming the charge.

More specifically, the source of vaporized fuel 40 consists of a housing 70 having a high pressure chamber 72 and a low pressure chamber 74. The high pressure chamber has a quantity of low lead or preferably no lead fuel such as gasoline 76 in the bottom thereof. The fuel 76 is introduced to the high pressure chamber 72 by means of a pump 78 via a valve 80 which is opened and closed by means of a float 82 in a well known manner. A sealed electrical resistance-type heating element 84 is positioned in the fuel 76 to heat same to the point where the fuel turns into a vapor. A pressure activated valve 86 is provided between the high pressure chamber 72 and low pressure chamber 74 to permit fuel vapor to enter the low pressure chamber 74 when the pressure of the fuel vapor in the high pressure chamber 72 reaches a predetermined or preselected amount which can be controlled by knob 88.

The electrical resistance-type heating element 84 is connected to a control 90 which determines when the heating element 84 will be energized. The control 90 operates in response to the temperature of the fuel 76 as measured by adjustable temperature sensor 92 and the pressure senses by high pressure sensor 94 and low pressure sensor 96. Sensors 92, 94 and 96 are electrically connected in series to control energization of heating element 84. The setting of sensor 92 is determined by the characteristics of the particular fuel being used whereas pressure sensors 94 and 96 are chosen for optimum safety and pollution considerations.

The low pressure chamber 74 is connected by piping 98 to the carburetor 38, and more specifically, to a jet 100 in the throat 102 of the carburetor. Air drawn into the throat 102 through filter 104 is controlled by means of the butterfly throttle valve 106 in the conventional manner. A linkage 108 connects the throttle valve 106 with a vapor flow control valve 110 in piping 98 which linkage 108 is in turn connected to an actuator (not shown) such as an accelerator pedal. A solenoid activated switch 112 is also provided in piping 98 which is connected to and activated to its open and closed position when the ignition switch of the vehicle is respectively in its on or off position. Thus, the molecules of fuel vapor entering the throat 102 via jet 100 from low pressure chamber 74 is combined with air molecules in the throat 102 of carburetor 38. This combination of air and fuel molecules is then drawn to the mixing device 64 by the suction existing in intake manifold 34.

The mixing device 64 comprises a screen 114 having a plurality of mixing holes 116 which are, for example, 1/64 inch in diameter. A shaft 118 is secured to the screen 114 and has a first propellor 120 and a second propellor 122 rotatably mounted on one section thereof above the screen 114 and a third propellor 124 rotatably mounted on the section of the shaft 118 beneath the screen 114. The direction of the pitch of the propellors 120, 122 is chosen such that they are caused to rotate counter to each other as the fuel and air combination is drawn around and past them into mixing holes 116. Propellor 124 is also caused to rotate as the thoroughly mixed combination of fuel and air molecules is drawn past it into intake manifold 34. The counter rotation of propellors 120,122, mixing holes 116 and rotating propellor 124 thoroughly mixes the combined vaporized fuel molecules and air molecules to form a charge which when introduced into the cylinders already heated according to the aforedescribed principles and means of the present invention, result in complete combustion during the power stroke with the resultant substantial increase in power and overall operating efficiency. This is in contrast to most conventional internal combustion engines which burn as much fuel on the exhaust stroke as on the power stroke or the fuel is not burned at all but carried out in the exhaust. Relief values are provided in the wall of the intake manifold 34 to permit the release of pressure from the manifold in the event of a premature ignition of the fuel in the manifold itself causing a backfire.

OPERATION

Figure 4:
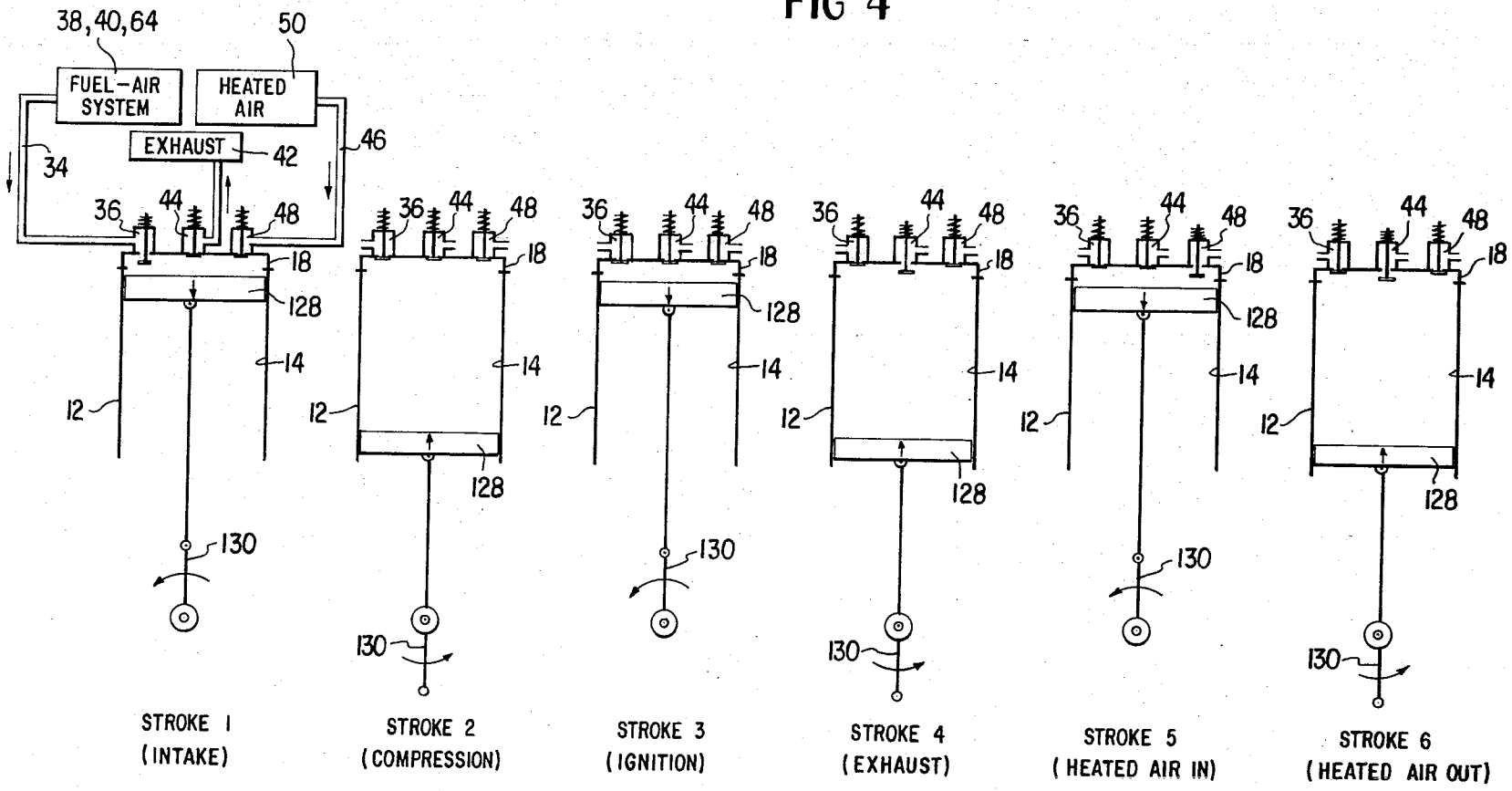
FIG. 4 is a diagrammatic illustration of an internal combustion engine having a six stroke cycle wherein preheated air is introduced during the 5th cycle.
Figure 2:
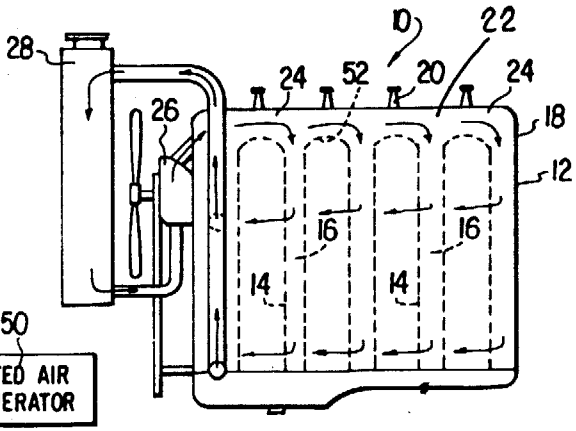
Figure 1:
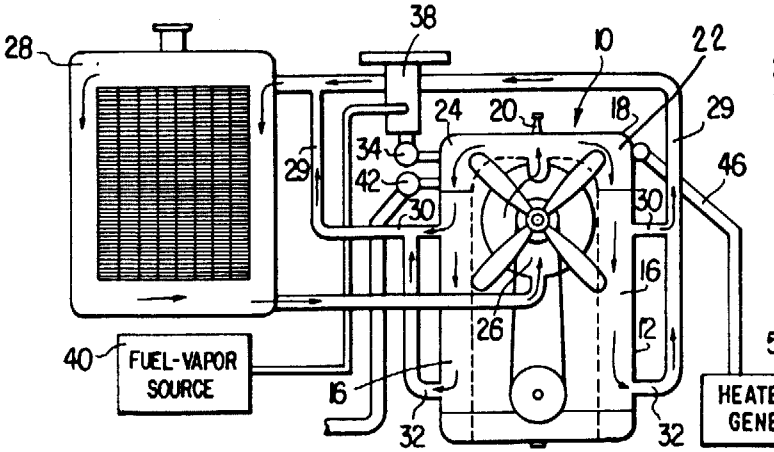

Referring to FIG. 4, the operation of the six stroke cycle engine 10 will be described assuming the direction of coolant flow as previously discussed which results in a higher and more even distribution of heat the length of the cylinder walls. The engine has three values, and intake valve 36, an exhaust valve 44 and a heated air inlet valve 48 all activated by conventional caming and the like, which in the interest of clarity has been eliminated in the drawings. The cylinder 14 has a reciprocating piston 128 connected to a crankshaft 130 in a well known manner. The fuel intake valve 36 and manifold 34 are connected to the aforedescribed fuel-air system comprising vaporized fuel generator 40, carburetor 38 and mixing device 64, the exhaust valve 44 is connected to exhaust manifold 44 and heated air inlet valve 48 is connected to heated air manifold 46.

The following is the sequence of operation of applicants' six stroke cycle engine:

Stroke 1 - Intake valve 36 is opened and the throughly mixed charge of fuel and air is drawn into the cylinder during the downward movement of piston 128.

Stroke 2 - All valves are closed and the charge heated by the cylinder walls is compressed.

Stroke 3 - All valves remain closed and the charge is ignited driving piston 128 down.

Stroke 4 - Exhaust valve 44 is opened and burnt gasses are expelled during upward stroke of piston 128.

Stroke 5 - Inlet valve 48 is opened and warm air from generator 50 is drawn into cylinder by the downward movement of piston 128, thereby further increasing the temperature of the cylinder walls 14 and engine head 18.

Stroke 6 - Exhaust valve 44 is again opened and the heated air is expelled.

Applicant has thus described his novel six stroke cycle engine and its operation, an engine which achieves very high operating efficiency due to the unique combustion of reversed coolant flow, ingested heated air on the 5th stroke of a six stroke cycle, and the completely mixed charge of air and vaporized fuel molecules resulting from applicants vaporized fuel generator, carburetor and mixing device.

While the invention has been particularly shown and described with reference to the preferred embodiments thereof, it will be understood by those skilled in the art that various changes in form and details may be made therein without departing from the spirit and scope of the invention.

What is claimed is:

1. In an internal combustion engine operating on a six stroke cycle, the combination comprising:

(a) at least one cylinder having a cylinder wall and a cylinder head therefor, said cylinder head having a fuel and air mixture intake valve, a preheated air purge valve and an exhaust valve communicating with said cylinder, said intake valve, said purge valve and said exhaust valve each being connected to a common respective intake, purge and exhaust manifold, (b) a piston operable in said cylinder, (c) means connected to said intake manifold for supplying a mixture of fuel and ambient air to said cylinder via said intake valve during the first cycle of said piston, which is then compressed and expanded during the second and third cycles, respectively, of said piston, and (d) means connected to said purge manifold for supplying air preheated to a temperature above that of ambient air to said cylinder for imparting heat to said wall of said cylinder to improve subsequent combustion of said mixture via said purge valve during the fifth cycle of said piston, said exhaust valve being opened during said fourth cycle of said piston for removing therefrom the products of combustion and opened during said sixth cycle of said piston for removing said preheated air.

2. In an internal combustion engine as set forth in claim 1 wherein said cylinder head and said cylinder have communicating water passages, said cylinder head having an inlet through which water is introduced to said passages from a source and said cylinder has an outlet adjacent the bottom thereof for returning said water to said source whereby said water in said cylinder head passages absorbs heat from said cylinder head prior to its travel to said cylinder where said absorbed head in said water is transferred to said cylinder to heat same.

3. In an internal combustion engine as set forth in claim 1 wherein said intake manifold has pressure relief valves associated therewith to permit gasses to escape therefrom in the event of backfire.

4. In an internal combustion engine as set forth in claim 1 wherein said means connected to said purge manifold for supplying preheated air is a heat exchanger in communication with said exhaust manifold wherein air is drawn over said exhaust manifold to preheat same prior to its introduction to said purge manifold.

5. In an internal combustion engine as set forth in claim 4 wherein said heat exchanger further comprises a thermostatically controlled electric resistance element which is energized to preheat said air to be preheated prior to the heating of said exhaust manifold by said products of combustion.

6. In an internal combustion engine as set forth in claim 1 wherein said means for supplying said mixture of fuel and air to said intake manifold comprises a means for transforming liquid fuel into fuel vapor, a carburetor device for combining said fuel vapor and a quantity of air, and a means for thoroughly mixing said molecules of fuel vapor with oxygen molecules.

7. In an internal combustion engine as set forth in claim 6 wherein said means for transforming liquid fuel into molecules of fuel vapor comprises:

(a) a first chamber having means therein for transforming liquid fuel into fuel vapor at high pressure, (b) a second chamber connected to said first chamber by way of a pressure regulated valve means for receiving said fuel vapor at low pressure, and (c) means for delivering said fuel vapor at low pressure to said mixing means.

8. In an internal combustion engine as set forth in claim 7 wherein said means for transforming liquid fuel into fuel vapor at high pressure is an electric heating element the energization of which is controlled in response to the temperature of said liquid fuel and the vapor pressure sensed in said first and second chambers.

9. In an internal combustion engine as set forth in claim 6 wherein said means for thoroughly mixing said fuel vapor and air comprises a plurality of mixing tubes extending in the direction of travel of said combined fuel vapor and air mixture and first and second freely rotating mixing propellors mounted adjacent one side of said mixing tubes and a third, freely rotating propellor mounted adjacent the other side of said mixing tubes.

10. In an internal combustion engine as set forth in claim 9 wherein said first and second mixing propellors counter rotate with respect to each other.

* * * * *

UNITED STATES PATENT AND TRADEMARK OFFICE

CERTIFICATE OF CORRECTION

PATENT NO. : 4,367,700 Page 1 of 2

DATED : January 11, 1983

INVENTOR(S) : James L. Pace

It is certified that error appears in the above-identified patent and that said Letters Patent is hereby corrected as shown below:

Figures 1 and 2 should appear as shown on the attached sheet.

Column 2, line 32, "FIG. 1" should read -- FIG. 2 --.

Column 5, line 9, "manifold 44" should read -- manifold 42 --.

Signed and Sealed this

*Twenty-eighth* Day of *June 1983*

[SEAL]

*Attest:*

GERALD J. MOSSINGHOFF

*Attesting Officer*

*Commissioner of Patents and Trademarks*